US010422544B2

(12) United States Patent
Sasaki et al.

(10) Patent No.: US 10,422,544 B2
(45) Date of Patent: Sep. 24, 2019

(54) INFORMATION NOTIFICATION METHOD AND RELOCATION DETERMINATION DEVICE

(71) Applicant: Panasonic Intellectual Property Management Co., Ltd., Osaka (JP)

(72) Inventors: Chieko Sasaki, Osaka (JP); Yuji Osaki, Osaka (JP); Hiroko Sugimoto, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 164 days.

(21) Appl. No.: 15/823,569

(22) Filed: Nov. 28, 2017

(65) Prior Publication Data

US 2018/0080674 A1 Mar. 22, 2018

Related U.S. Application Data

(63) Continuation of application No. PCT/JP2017/013897, filed on Apr. 3, 2017.

(30) Foreign Application Priority Data

Apr. 12, 2016 (JP) ..... 2016-079450
Mar. 1, 2017 (JP) ..... 2017-038425

(51) Int. Cl.

*F24F 11/00* (2018.01)
*F24F 11/30* (2018.01)
*F24F 11/89* (2018.01)
*F24F 11/52* (2018.01)

(52) U.S. Cl.

CPC ..... *F24F 11/30* (2018.01); *F24F 11/00* (2013.01); *F24F 11/89* (2018.01); *F24F 11/52* (2018.01)

(58) Field of Classification Search

CPC .. F24F 11/00; F24F 11/30; F24F 11/52; F24F 11/89; F25B 2345/002; F25B 2345/003; F25B 2500/26; F25B 2600/01

See application file for complete search history.

(56) References Cited

U.S. PATENT DOCUMENTS 5,201,188 A * 4/1993 Sakuma ..... F25B 45/00 62/149
2015/0219349 A1* 8/2015 Means ..... F24F 11/30 701/484

FOREIGN PATENT DOCUMENTS

JP 2002-107015 4/2002

OTHER PUBLICATIONS

International Search Report of PCT application No. PCT/JP2017/013897 dated Jun. 27, 2017.

* cited by examiner

*Primary Examiner* — Jonathan Bradford
(74) *Attorney, Agent, or Firm* — Greenblum & Bernstein, P.L.C.

(57) ABSTRACT

An information notification method for use in an information notification system connected to an air conditioner including a refrigerant circuit and an information communication apparatus includes detecting a connection state indicating whether the air conditioner is connected to a network, determining whether the air conditioner performed a refrigerant recovery operation on the refrigerant circuit on the basis of the operation log information that indicates an operation log of the air conditioner and that is received from the air conditioner, determining whether the air conditioner has been relocated on the basis of the detected connection state and the determination as to whether the air conditioner performed the refrigerant recovery operation, and sending, to the information communication apparatus, first information used to prompt for a test operation of the air conditioner if it is determined that the air conditioner has been relocated.

12 Claims, 16 Drawing Sheets

FIG. 5

| | COLLECTION TIME | OPERATION MODE | OPERATING TIME | SETTING TEMPERATURE |
|---|---|---|---|---|
| | ... | ... | ... | ... |
| R101 | 2013/3/4 12:10 | HEATING | 60 | 19 |
| | ... | ... | ... | ... |
| R102 | 2014/3/4 12:10 | HEATING | 20 | 19 |
| | ... | ... | ... | ... |
| R103 | 2015/3/4 12:10 | COOLING | 15 | 16 |
| R104 | 2015/3/4 12:20 | STOPPED | 0 | 16 |

FIG. 10

| | COLLECTION TIME | TIME OF OPERATION LOG | OPERATION MODE | OPERATING TIME | SETTING TEMPERATURE |
|---|---|---|---|---|---|
| | ... | ... | ... | ... | ... |
| R201 | 2013/3/4 11:20 | 2013/3/4 11:20 | HEATING | 60 | 19 |
| | ... | ... | ... | ... | ... |
| R202 | 2014/3/4 11:20 | 2014/3/4 11:20 | HEATING | 20 | 19 |
| | ... | ... | ... | ... | ... |
| R203 | 2015/3/4 11:00 | NO NETWORK CONNECTION | – | – | – |
| | ... | ... | ... | ... | ... |
| R204 | 2015/3/4 11:30 | 2015/3/4 11:05 | STOPPED | 0 | 16 |
| R205 | 2015/3/4 11:30 | 2015/3/4 11:20 | COOLING | 10 | 16 |
| R206 | 2015/3/4 11:30 | 2015/3/4 11:25 | STOPPED | 0 | 16 |

FIG. 13

| | COLLECTION TIME | ROOM TEMPERATURE | OUTDOOR TEMPERATURE |
|---|---|---|---|
| R301 | 2015/3/4 0:00 | 13 | 8 |
| | 2015/3/4 1:00 | 12 | 8 |
| | 2015/3/4 2:00 | 11 | 7 |
| | 2015/3/4 3:00 | 11 | 7 |
| | 2015/3/4 4:00 | 11 | 7 |
| | 2015/3/4 5:00 | 10 | 7 |
| | 2015/3/4 6:00 | 15 | 8 |
| | 2015/3/4 7:00 | 18 | 9 |
| | 2015/3/4 8:00 | 18 | 10 |
| | 2015/3/4 9:00 | 13 | 11 |
| | 2015/3/4 10:00 | 13 | 12 |
| | 2015/3/4 11:00 | 14 | 14 |
| | 2015/3/4 12:00 | 14 | 15 |
| | 2015/3/4 13:00 | 14 | 17 |
| | 2015/3/4 14:00 | 15 | 17 |
| | 2015/3/4 15:00 | 16 | 16 |
| | 2015/3/4 16:00 | 15 | 16 |
| | 2015/3/4 17:00 | 17 | 16 |
| | 2015/3/4 18:00 | 19 | 14 |
| | 2015/3/4 19:00 | 18 | 12 |
| | 2015/3/4 20:00 | 19 | 10 |
| | 2015/3/4 21:00 | 18 | 10 |
| | 2015/3/4 22:00 | 18 | 10 |
| R302 | 2015/3/4 23:00 | 18 | 9 |

FIG. 14

R401

| COLLECTION TIME | ROOM TEMPERATURE | OUTDOOR TEMPERATURE |
|---|---|---|
| ... | ... | ... |
| 2013/3/4 0:00 | 15 | 6 |
| 2013/3/4 1:00 | 12 | 5 |
| 2013/3/4 2:00 | 10 | 4 |
| 2013/3/4 3:00 | 10 | 4 |
| 2013/3/4 4:00 | 10 | 4 |
| 2013/3/4 5:00 | 9 | 5 |
| 2013/3/4 6:00 | 15 | 7 |
| 2013/3/4 7:00 | 17 | 7 |
| 2013/3/4 8:00 | 18 | 8 |
| 2013/3/4 9:00 | 12 | 9 |
| 2013/3/4 10:00 | 10 | 11 |
| 2013/3/4 11:00 | 10 | 13 |
| 2013/3/4 12:00 | 11 | 14 |
| 2013/3/4 13:00 | 14 | 14 |
| 2013/3/4 14:00 | 15 | 15 |
| 2013/3/4 15:00 | 15 | 15 |
| 2013/3/4 16:00 | 15 | 14 |
| 2013/3/4 17:00 | 18 | 14 |
| 2013/3/4 18:00 | 20 | 12 |
| 2013/3/4 19:00 | 18 | 9 |
| 2013/3/4 20:00 | 18 | 6 |
| 2013/3/4 21:00 | 18 | 6 |
| 2013/3/4 22:00 | 18 | 5 |
| 2013/3/4 23:00 | 18 | 5 |
| ... | ... | ... |

R402

R403

| | | |
|---|---|---|
| ... | ... | ... |
| 2014/3/4 0:00 | 15 | 6 |
| 2014/3/4 1:00 | 12 | 5 |
| 2014/3/4 2:00 | 10 | 4 |
| 2014/3/4 3:00 | 10 | 4 |
| 2014/3/4 4:00 | 10 | 4 |
| 2014/3/4 5:00 | 9 | 5 |
| 2014/3/4 6:00 | 15 | 7 |
| 2014/3/4 7:00 | 17 | 7 |
| 2014/3/4 8:00 | 18 | 8 |
| 2014/3/4 9:00 | 12 | 9 |
| 2014/3/4 10:00 | 10 | 11 |
| 2014/3/4 11:00 | 10 | 13 |
| 2014/3/4 12:00 | 11 | 14 |
| 2014/3/4 13:00 | 14 | 14 |
| 2014/3/4 14:00 | 15 | 15 |
| 2014/3/4 15:00 | 15 | 15 |
| 2014/3/4 16:00 | 15 | 14 |
| 2014/3/4 17:00 | 20 | 14 |
| 2014/3/4 18:00 | 21 | 12 |
| 2014/3/4 19:00 | 18 | 9 |
| 2014/3/4 20:00 | 18 | 6 |
| 2014/3/4 21:00 | 19 | 6 |
| 2014/3/4 22:00 | 19 | 5 |
| 2014/3/4 23:00 | 19 | 5 |
| ... | ... | ... |

R404

| | | ROOM TEMPERATURE | OUTDOOR TEMPERATURE |
|---|---|---|---|
| R501 | CORRELATION BETWEEN DATA COLLECTED IN THE SAME PERIOD IN 2013 AND ONE-DAY DATA OF TODAY | 0.574037731 | 0.896909661 |
| R502 | CORRELATION BETWEEN DATA COLLECTED IN THE SAME PERIOD IN 2013 AND DATA COLLECTED IN THE SAME PERIOD IN 2014 | 0.993791446 | 0.963637753 |

| | MODIFICATION DATE AND TIME | AIR CONDITIONER IDENTIFICATION NUMBER | IP ADDRESS |
|---|---|---|---|
| R601 | 2015/3/4 11:00 | 00000001 | 234.567.890.123 |
| R602 | 2014/1/3 0:00 | 00000123 | 567.890.123.456 |
| | | ... | ... |

INFORMATION NOTIFICATION METHOD AND RELOCATION DETERMINATION DEVICE

BACKGROUND

1. Technical Field

The present disclosure relates to a method for detecting relocation of an air conditioner, an information notification method for notifying a user that an air conditioner has been relocated, and a relocation determination device.

2. Description of the Related Art

The air conditioner is supposed to be used for a long time and, thus, the air conditioner may be relocated from the original installation location due to a move of the owner or change of the user. When relocating an air conditioner having the outdoor unit and the indoor unit connected to each other via a refrigerant pipe, an engineer having knowledge about the air conditioner performs the refrigerant recovery work so that the refrigerant in the refrigerant pipe is not discharged to the atmosphere. Thereafter, the engineer removes the outdoor unit and the indoor unit and installs the units again in a new location. When the air conditioner is not properly relocated, the heating and cooling capacity may be insufficient due to insufficient refrigerant during the operation of the air conditioner, or some unit of the air conditioner may be damaged due to frequent start failure and restart of the compressor of the outdoor unit caused by abnormal pressure in the refrigerant pipe.

In consideration of a case where the air conditioner is not properly relocated, a system that protects a unit of the air conditioner by detecting the relocation or a system that detects a failure during operation after the relocation and notifies the user of the failure.

SUMMARY

One non-limiting and exemplary embodiment provides a further improved method for detecting relocation of the air conditioner.

In one general aspect, the techniques disclosed here feature an information notification method for use in an information notification system connected to an air conditioner including a refrigerant circuit and an information communication apparatus via a network. The information notification method includes detecting a connection state indicating whether the air conditioner is connected to the network, receiving, from the air conditioner, operation log information indicating an operation log of the air conditioner, determining whether the air conditioner performed a refrigerant recovery operation on the refrigerant circuit on the basis of the operation log information, determining whether the air conditioner has been relocated on the basis of the detected connection state and the determination as to whether the air conditioner performed the refrigerant recovery operation, and sending, to the information communication apparatus, first information used to prompt for a test operation of the air conditioner if it is determined that the air conditioner has been relocated.

According to the above-described aspect further improvements have been achieved.

These general and specific aspects may be implemented using a system, a method, and a computer program, and any combination of systems, methods, and computer programs.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 5 illustrates an example of an operation log collected from an air conditioner and stored in a storage device 64 according to the first embodiment of the present disclosure;

FIG. 10 illustrates an example of an operation log collected from a memory of an air conditioner and stored in a storage device 64 according to the second embodiment of the present disclosure;

FIG. 13 illustrates an example of sensor information collected for one day after communication of an air conditioner 1 is disabled and stored in the storage device 64 according to a third embodiment of the present disclosure;

FIG. 14 illustrates an example of sensor information collected in the past years at the same period and stored in the storage device 64 according to the third embodiment of the present disclosure;

DETAILED DESCRIPTION

Figure 1:
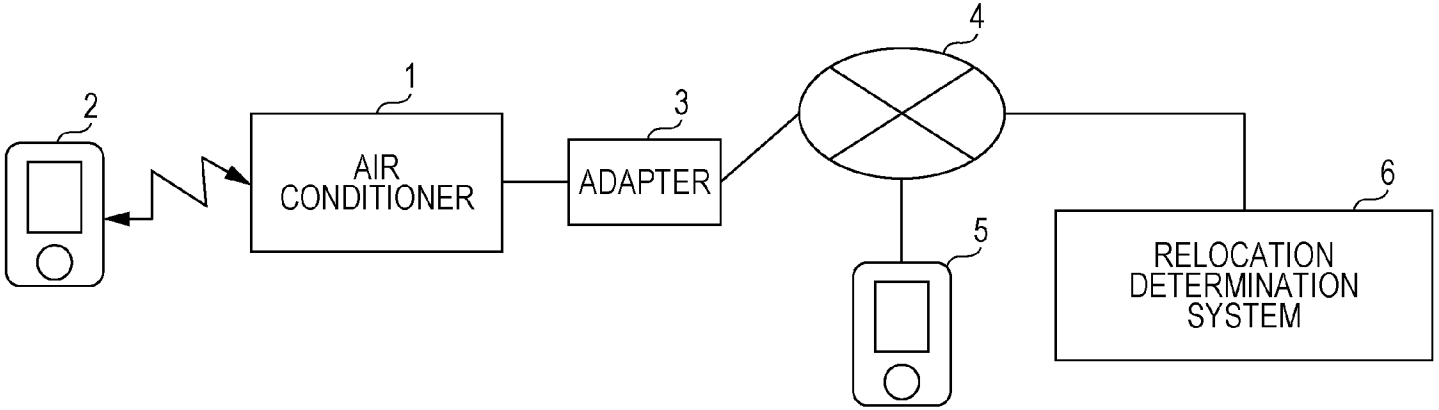
FIG. 1 illustrates an example of an entire system configuration according to an embodiment of the present disclosure.

Underlying Knowledge Forming Basis of the Present Disclosure

When relocating an air conditioner, an engineer collects the refrigerant in the refrigerant pipe that connects the indoor unit to the outdoor unit of the air conditioner into the outdoor unit without circulating the refrigerant from the outdoor unit to the indoor unit. Accordingly, the engineer closes a valve that enables the refrigerant to circulate from the indoor unit to the outdoor unit, performs a refrigerant recovery operation, and closes a valve that enables the refrigerant to circulate from the indoor unit to the outdoor unit. The refrigerant recovery operation is performed by setting the operation mode of the air conditioner to a cooling mode and operating the air conditioner for a short time. The short time means about 2 to 3 minutes, which may be somewhat longer depending on the work procedure and the time required by the engineer. Thereafter, the engineer powers off the air conditioner and removes the refrigerant pipe, the indoor unit, and the outdoor unit of the air conditioner.

According to Japanese Patent No. 4013471, completion of the refrigerant recovery operation is detected on the basis of the refrigerant pressure in the refrigerant pipe, and it is determined that the air conditioner has been relocated. If, during the subsequent operation, a high pressure in the refrigerant pipe is detected, it is determined that the air conditioner has not been properly relocated, and the compressor is kept stopped. In this manner, damage of the equipment parts of the compressor in the outdoor unit can be prevented.

However, depending on the usage environment and installation conditions, the refrigerant in the refrigerant pipe may leak slightly on a daily basis. If the amount of the refrigerant held in the air conditioner is small, circulation of the refrigerant in the refrigerant pipe decreases and, thus, the refrigerant pressure becomes the same as that for the refrigerant recovery operation. Consequently, according to the technique described in Japanese Patent No. 4013471, misdetection may occur. In this case, despite the fact that the air conditioner has not been relocated, restarting of the compressor is prevented. If the compressor fails to start even once, the air conditioner remains stopped and cannot operate.

According to an aspect, an information notification method for use in an information notification system connected to an air conditioner including a refrigerant circuit and an information communication apparatus via a network is provided. The information notification method includes detecting a connection state indicating whether the air conditioner is connected to the network, receiving, from the air conditioner, operation log information indicating an operation log of the air conditioner, determining whether the air conditioner performed a refrigerant recovery operation on the refrigerant circuit on the basis of the operation log information, determining whether the air conditioner has been relocated on the basis of the detected connection state and the determination as to whether the air conditioner performed the refrigerant recovery operation, and sending, to the information communication apparatus, first information used to prompt for a test operation of the air conditioner if it is determined that the air conditioner has been relocated.

According to the above aspect, it is determined whether the air conditioner has been relocated on the basis of the network connection information of the air conditioner and whether the refrigerant recovery operation was performed. If it is determined that the air conditioner has been relocated, a message prompting the user to perform a test operation of the air conditioner is sent. In this manner, the need for detecting the refrigerant pressure in the refrigerant pipe when the amount of the refrigerant held in the air conditioner is small is eliminated and, thus, misdetection of relocation of the air conditioner can be prevented. In addition, by determining whether network connection is established in addition to determining whether the user ran the cooling operation of the air conditioner for a short time, misdetection that occurs when, for example, the user unintentionally starts a cooling operation and immediately stops the cooling operation can be prevented.

According to the above aspect, when, for example, it is determined that the air conditioner has performed the refrigerant recovery operation and if it is detected that the air conditioner is not connected to the network, it may be determined that the air conditioner has been relocated. According to the above aspect, when an operation corresponding to the refrigerant recovery operation for the refrigerant circuit is performed and it is detected that the air conditioner is not connected to the network, it is determined that the air conditioner has been relocated. Thus, for example, when the engineer performs an operation corresponding to the refrigerant recovery operation and, thereafter, uninstalls the air conditioner from the installation location, the air conditioner is disconnected from the network. In such a case, the air conditioner relocation work can be detected on the basis of the operation log information.

According to the above aspect, for example, the operation log information may include an operating start time, an operation mode, a setting temperature, and an operating time of the air conditioner. In this manner, it can be accurately determined whether the refrigerant recovery operation has been performed.

According to the above aspect, for example, if the operation log information indicates that the air conditioner was not operated in the same period of past years as first date and time and in the same operation mode as at the first date and time, it is determined that the refrigerant recovery operation is performed at the first date and time. The refrigerant recovery operation is similar to the ordinary cooling operation, and in general, a cooling operation is not carried out during the period of time from fall to spring, during which the ambient temperature is low, for example. Based on the above consideration, it can be determined that the cooling operation carried out this year is a refrigerant recovery operation if a cooling operation carried out this year is detected although a cooling operation has not been carried out in the same period of the past years.

According to the above aspect, for example, if the operation log information indicates that a continuous operating time of the air conditioner at a first date and time is within a predetermined time, it may be determined that the refrigerant recovery operation is performed at the first date and time. As a result, since in general, an ordinary refrigerant recovery operation is completed in a short time of, for example, about 5 minutes, it can be determined that a refrigerant recovery operation is performed if the continuous operating time is within a predetermined time range.

According to the above aspect, for example, if it is detected that the air conditioner is not connected to the network at the first date and the air conditioner is connected to the network again at a second date and time, it may be determined whether the refrigerant recovery operation was performed in a period of time of the past years from the first date and time to the second date and time on the basis of the operation log information. If it is determined that the refrigerant recovery operation was performed, it may be determined that the air conditioner has been relocated. In this manner, even when an engineer relocates the air conditioner and disconnects the network from the air conditioner before performing the refrigerant recovery operation, the relocation can be detected.

According to the above aspect, for example, the operation log information may include an operating start time, an operation mode, a setting temperature, an operating time, and a network connection/disconnection state of the air conditioner. In this manner, it can be accurately determined whether the air conditioner has been relocated.

According to the above aspect, for example, the air conditioner may include an indoor unit and an outdoor unit, and the operation log information may include first temperature information indicating a room temperature in a room in which the indoor unit is installed and second temperature information indicating a temperature of outdoor air in which the outdoor unit is installed. In this manner, for example, the installation environments of the outdoor unit and the indoor unit which change as the air conditioner is relocated, and it can be determined whether the air conditioner has been relocated on the basis of a change in the installation environment.

If it is detected that the air conditioner is not connected to the network at a first date and time and the air conditioner is connected to the network again at a second date and time, first information and second information may be calculated on the basis of the operation log information, where the first information indicates a temperature change tendency of an installation environment of the air conditioner during a first time period that starts from the second date and time and that is smaller than or equal to a predetermined time period, and the second information indicates a temperature change tendency of the installation environment of the air conditioner during a second time period that is the same time period of the past years as the first time period. The first information may be compared with the second information. If there is no predetermined correlation between the first information and the second information, it may be determined that the air conditioner has been relocated.

In this manner, the temperature change tendencies of the installation environment in two predetermined time periods before and after the network disconnection occurs are compared with each other. As a result, for example, a change in the installation environment can be detected more accurately than in the case where the temperatures at given points in time before and after the network disconnection occurs are compared with each other.

According to the above aspect, for example, connection information indicating a network connection state of the air conditioner may be acquired. If it is detected that the air conditioner is not connected to the network at a first date and time and the air conditioner is connected to the network again at a second date and time, first connection information representing the connection information before the first date and time may be compared with second connection information representing the connection information after the second date and time. If the first connection information is not the same as the second connection information, it may be determined that the air conditioner has been relocated. In this manner, even when the network connection environment changes due to the move of the user, it can be detected that the air conditioner has been relocated. As a result, a message prompting the user to perform a test operation can be sent promptly.

According to the above aspect, for example, the information communication apparatus may include a touch-sensitive display. The first information may include a program that displays a graphical user interface including an icon on the touch-sensitive display. Control information that causes the air conditioner to perform a test operation may be sent from the information communication apparatus via a network in response to an operation performed on the icon via the touch-sensitive display. In this manner, for example, at the same time as informing the user of the need for a test operation, the graphical user interface including an icon for running a test operation is displayed on the touch display. As a result, the user can perform a test operation on the air conditioner simply by operating the displayed icon without having to look into a way to run a test operation.

According to another aspect, a relocation determination device that is connected to an air conditioner including a refrigerant circuit and an information communication apparatus via a network and that determines whether an air conditioner is relocated is provided. The device includes a communication unit that performs communication with the air conditioner and the information communication apparatus, a connection state detection unit that detects a connection state indicating whether the air conditioner is connected to the network, a storage unit that stores operation log information that is received from the air conditioner and that indicates an operation log of the air conditioner, a refrigerant recovery operation determination unit that determines whether the air conditioner has performed the refrigerant recovery operation on the refrigerant circuit on the basis of the operation log information, and a relocation determination unit that determines whether the air conditioner has been relocated on the basis of the detected connection state and the determination as to whether the air conditioner has performed the refrigerant recovery operation. If it is determined that the air conditioner has been relocated, first information used to prompt for a test operation of an air conditioner is sent to the information communication apparatus.

According to the above aspect, the operation log information of the air conditioner is received. It is determined that an operation corresponding to the refrigerant recovery operation on the refrigerant circuit has been performed on the basis of the operation log information. If the air conditioner is not connected to the network, it is determined that the air conditioner has been relocated and a message prompting the user to perform a test operation of the air conditioner is sent. By using the operation log information, it is determined whether an engineer has performed an operation corresponding to the refrigerant recovery operation on the basis of the operation mode and the operating time, and it is further determined whether the air conditioner is powered off by determining whether the air conditioner is not connected to the network. In this manner, it is determined whether a work for relocating the air conditioner has been performed. In this manner, the need for detecting the refrigerant pressure in the refrigerant pipe when the amount of the refrigerant held in the air conditioner is small is eliminated and, thus, misdetection of relocation of the air conditioner can be prevented. In addition, by determining whether network connection is established in addition to determining whether the user ran the cooling operation of the air conditioner for a short time, misdetection that occurs when, for example, the user unintentionally starts a cooling operation and immediately stops the cooling operation can be prevented.

It should be noted that each of the embodiments below describes a specific example of the present disclosure. A value, a shape, a constituent element, steps, and the sequence of steps used in the embodiments are only examples and shall not be construed as limiting the scope of the present disclosure. In addition, among the constituent elements in the embodiments described below, the constituent element that does not appear in an independent claim, which has the broadest scope, is described as an optional constituent element. In addition, all of the embodiments may be combined in any way.

First Embodiment

The configuration of an information notification system connected to an air conditioner having a refrigerant circuit and an information communication apparatus via a network according to the present embodiment is described first. FIG. 1 illustrates an example of the configuration of a relocation determination system 6 that is connected to the air conditioner 1 via a global network 4 according to the embodiment of the present disclosure. The system monitors the operation log of the air conditioner 1 remotely via the network. Examples of the operation log include a power ON state or power OFF state of the air conditioner 1, a state of an operation mode, such as a cooling mode or a heating mode, a setting temperature, and a value output from a temperature sensor mounted in the air conditioner 1. The air conditioner 1 receives a request, such as a power ON request or a temperature setting change request, from the user via a remote controller 2. The air conditioner 1 communicates with the remote controller 2 via, for example, infrared communication. In addition, the air conditioner 1 is connected to the global network 4 via an adapter 3. The adapter 3 is connected to the air conditioner 1 via a wire, for example, and has a function of connecting the global network 4 with the air conditioner 1. The adapter 3 may be mounted inside the air conditioner 1 or may be connected to the air conditioner 1 via radio. Furthermore, like a gateway, the adapter 3 has a protocol conversion function and a packet transmission/reception function. That is, like a modem, the adapter 3 has a function of converting between different transmission path media. The adapter 3 may be composed of a single device or may have the above-described functions by connecting a plurality of devices by wired or wireless connection. When the user connects a terminal 5 having a communication function and a display screen (e.g., a cell phone or a smartphone) to the global network 4, the user can send a request, such as a power ON request or a temperature setting change request, from even the terminal 5 to the air conditioner 1. The air conditioner 1 receives the request via the adapter 3 and the global network 4. The relocation determination system 6 can exchange information with the terminal 5 via the global network 4 (e.g., information to be displayed on a display screen of the terminal 5, such as the operation log of the air conditioner 1, and a screen for receiving a request from the user). Note that since the global network 4 is a general public line, other air conditioners and other connectable apparatuses (not illustrated in FIG. 1) are also connected to the global network 4, so that the relocation determination system 6 can monitor a plurality of air conditioners and exchange information with a plurality of terminals.

Figure 2:
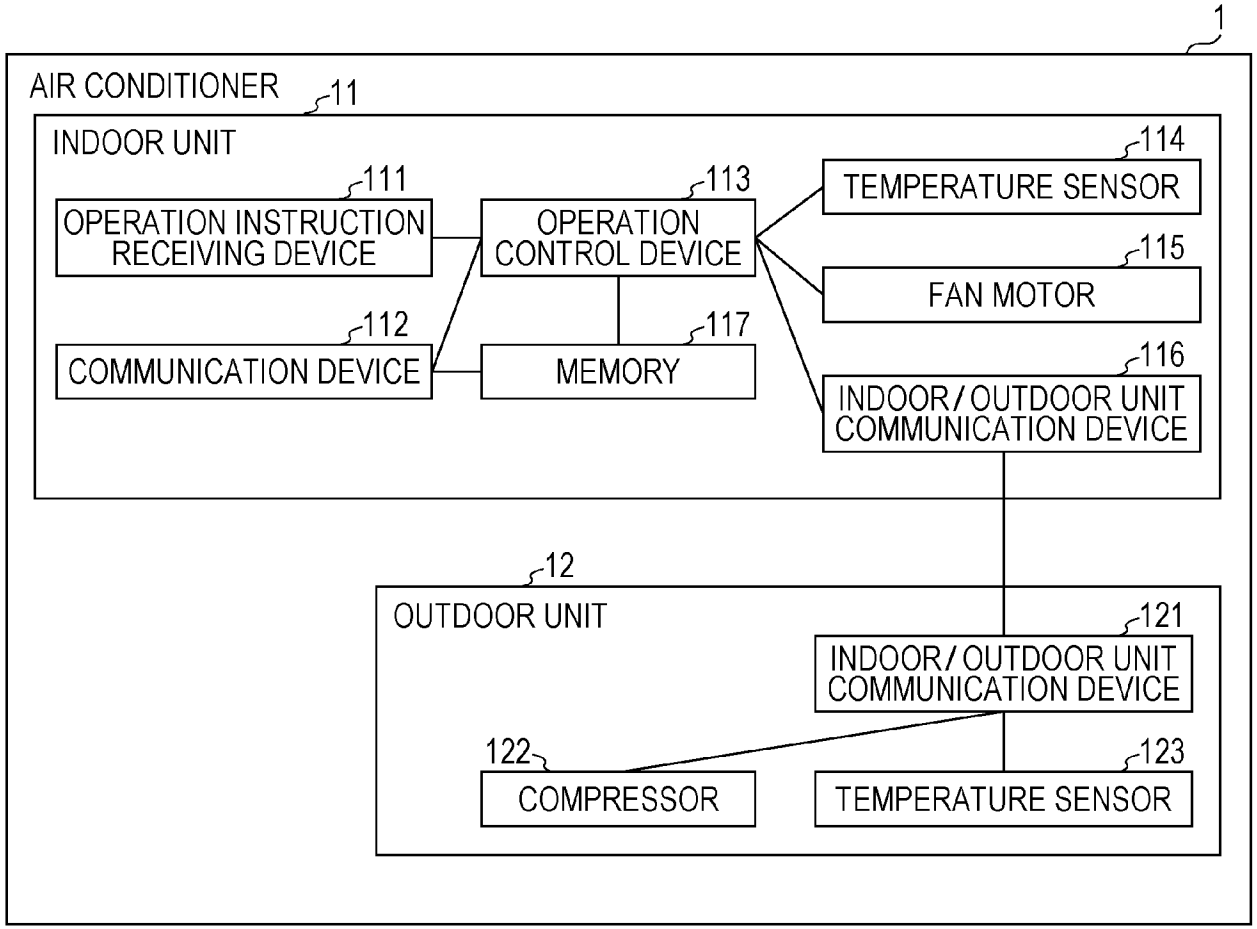
FIG. 2 is a block diagram illustrating an example of the configuration of an air conditioner 1 according to an embodiment of the present disclosure.

FIG. 2 is a configuration diagram of the air conditioner 1. The air conditioner 1 has an indoor unit 11 installed in a room and an outdoor unit 12 installed outside the room, and the indoor unit 11 and the outdoor unit 12 are connected to each other by using a refrigerant pipe and a communication line.

The indoor unit 11 includes an operation instruction receiving device 111, an operation control device 113, a fan motor 115, a temperature sensor 114, a memory 117, a communication device 112, and an indoor/outdoor unit communication device 116.

The operation instruction receiving device 111 receives an operation instruction request from the user with an infrared ray or the like. The operation control device 113 drives the internal devices of the indoor unit 11 and the outdoor unit 12 in accordance with the instruction received from the user by the operation instruction receiving device 111. The fan motor 115 sends, to the room, hot air or cool air flowing from the outdoor unit 12 through the refrigerant pipe. The temperature sensor 114 measures the air temperature in the room in which the indoor unit 11 is installed. The memory 117 holds a plurality of pieces of information, such as an operation instruction request from a user, the sensor information in the air conditioner 1, and an operation log of the air conditioner 1. The communication device 112 processes communication performed via the adapter 3 and the global network 4. The indoor/outdoor unit communication device 116 transmits and receives information to and from the outdoor unit 12 via the communication line.

The outdoor unit 12 includes a compressor 122, a temperature sensor 123, and an indoor/outdoor unit communication device 121.

The compressor 122 compresses the refrigerant. The temperature sensor 123 measures the temperature of the outdoor in which the outdoor unit 12 is installed. The indoor/outdoor unit communication device 121 transmits and receives information to and from the indoor unit 11 via the communication line. Examples of the information transmitted and received between the indoor/outdoor unit communication device 116 and the indoor/outdoor unit communication device 121 include the values from the temperature sensors mounted in the indoor unit 11 and the outdoor unit 12, the operation instruction request from the user, and a specified frequency used when the compressor 122 is operated. The indoor unit 11 performs operation control on the basis of the received information, and the outdoor unit 12 operates the mounted compressor in accordance with the specified frequency.

Note that only the sensors for measuring the indoor and outdoor temperatures are mounted on the indoor unit 11 and the outdoor unit 12 illustrated in FIG. 2, respectively. However, temperature sensors may be mounted at a plurality of locations, such as locations around the refrigerant pipe and an air outlet. In addition to the temperature sensor, other types of sensors, such as a human sensor and an illuminance sensor, may be mounted to control the air conditioner 1. Although the operation control device is not illustrated in the outdoor unit 12 in FIG. 2, the operation control device may be also mounted in the outdoor unit 12.

Figure 3:
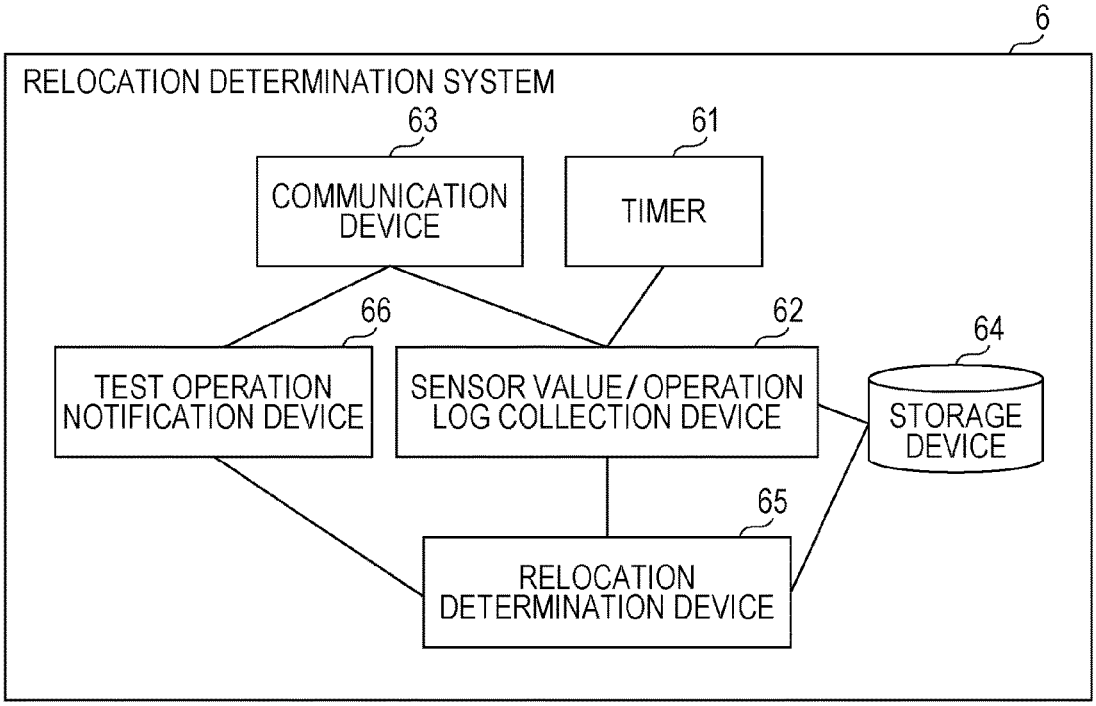
FIG. 3 is a block diagram illustrating the configuration of a relocation determination system 6 of an air conditioner according to an embodiment of the present disclosure.

FIG. 3 illustrates an internal configuration of the relocation determination system 6. The relocation determination system 6 includes a communication device 63, a sensor value/operation log collection device 62, a timer 61, a relocation determination device 65, a test operation notification device 66, and a storage device 64.

The communication device 63 has a function of connecting the relocation determination system 6 to the global network 4. To transmit and receive information to and from the air conditioner connected to the global network 4, the communication device 63 stores, in the storage device 64, the IP address and the identification information of the air conditioner 1 connected to the global network 4. The sensor value/operation log collection device 62 periodically receives information, such as the sensor value and the operation log, from the air conditioner 1 connected to the global network 4 in accordance with the time indicated by the timer 61 and stores, in the storage device 64, the received information together with the received time. If the sensor value/operation log collection device 62 cannot receive the information from the air conditioner 1, the air conditioner 1 stores, in the storage device 64, information indicating that the air conditioner 1 is not connected to the network together with the time at which reception of the information is failed. The relocation determination device 65 retrieves the operation log and sensor information collected from the past to the present and stored in the storage device 64 in terms of the air conditioner 1 and determines whether the air conditioner 1 has been relocated. The relocation determination device 65 holds the result of determination. If the relocation determination device 65 determines that the air conditioner 1 has been relocated, the test operation notification device 66 sends, to the air conditioner 1 (via the communication device 63), a message prompting the user to perform a test operation.

Instead of the sensor value/operation log collection device 62 that periodically retrieves the information in accordance with the time indicated by the timer 61, the air conditioner 1 may send the information to the relocation determination system 6 when the information regarding the air conditioner 1 or the network connection state is changed. It should be noted that general or specific embodiments of the relocation determination system 6 may be implemented as a system, a server, a method, an integrated circuit, a computer program, a computer-readable storage medium, such as a CD-ROM, or any selective combination thereof.

The operation performed by the relocation determination system 6 is described below with reference to FIGS. 4 and 5.

Figure 4:
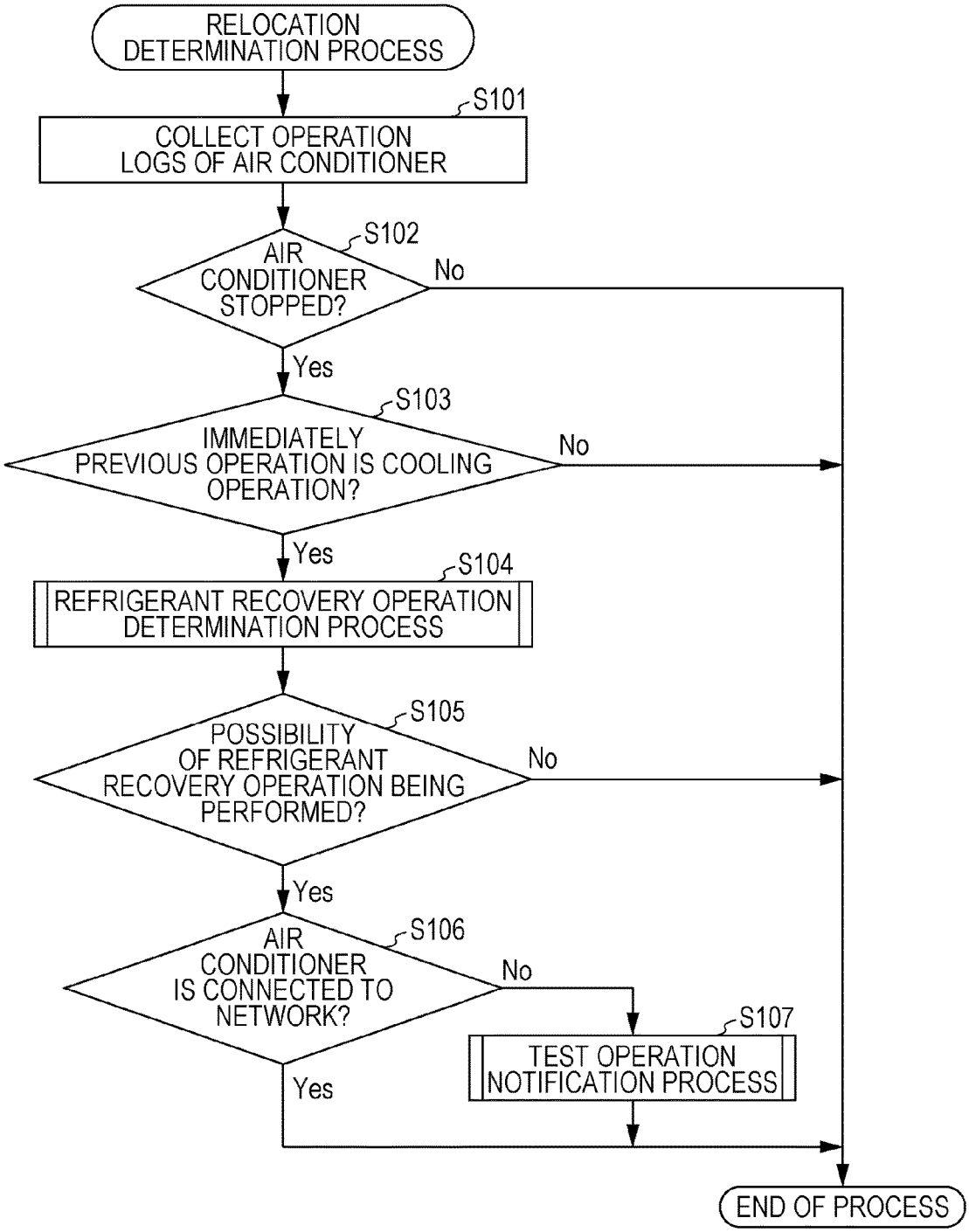
FIG. 4 is a flowchart illustrating an air conditioner relocation detection process according to a first embodiment of the present disclosure.

FIG. 4 is a flowchart of the operation process performed by the relocation determination system 6. The relocation determination system 6 periodically and continuously performs the process in order to detect whether the air conditioner 1 has been relocated.

The sensor value/operation log collection device 62 collects the operation log and sensor information of the air conditioner 1 and stores the operation log and sensor information in the storage device 64 (S101) first. The relocation determination device 65 determines whether the air conditioner 1 is stopped on the basis of the above-described operation log. If the air conditioner 1 is not stopped (No in S102), the relocation determination device 65 completes the process. If the air conditioner 1 is stopped in the above determination (Yes in S102), it is determined whether the cooling operation was performed before the stoppage. If the cooling operation was not performed (No in S103), the relocation determination device 65 completes the process. If the operation log indicates that the cooling operation was performed before the stoppage (Yes in S103), the relocation determination device 65 performs a refrigerant recovery operation determination process for determining whether the cooling operation corresponds to the refrigerant recovery operation (S104). If it is determined that there is no possibility of a refrigerant recovery operation being performed (No in S105), the relocation determination device 65 completes the process. If, in the refrigerant recovery operation determination process (S104), it is determined that there is a possibility of the refrigerant recovery operation being performed (Yes in S105), the relocation determination device 65 determines whether the air conditioner 1 was powered off for relocation by determining whether the air conditioner 1 is connected to the network. If the air conditioner 1 is connected to the network (Yes in S106), the relocation determination device 65 completes the process. If, in the above determination process, the air conditioner 1 is not connected to the network (No in S106), the relocation determination device 65 performs a test operation notification process (S107) in which the test operation notification device 66 sends a message prompting for a test operation to the air conditioner 1 and completes the process.

The refrigerant recovery operation determination process (S104) is described in detail below with reference to FIG. 5 and FIG. 6.

FIG. 5 illustrates an example of the operation log stored in the storage device 64. The operation log stored in R104 is the operation log currently being collected. The operation log stored in R103 is the operation log collected previously. R101 and R102 denote the operation logs collected in the same time period in the past.

In the example illustrated in FIG. 5, the operating state is collected from the air conditioner 1 every 10 minutes. However, the collection interval may differ from 10 minutes. In the above description of R104 and R103, R104 and R103 denote the operation log collected at the present time and the operation log collected immediately previously, respectively. However, a plurality of operation logs may be collected in one go and be stored in the storage device 64.

Figure 6:
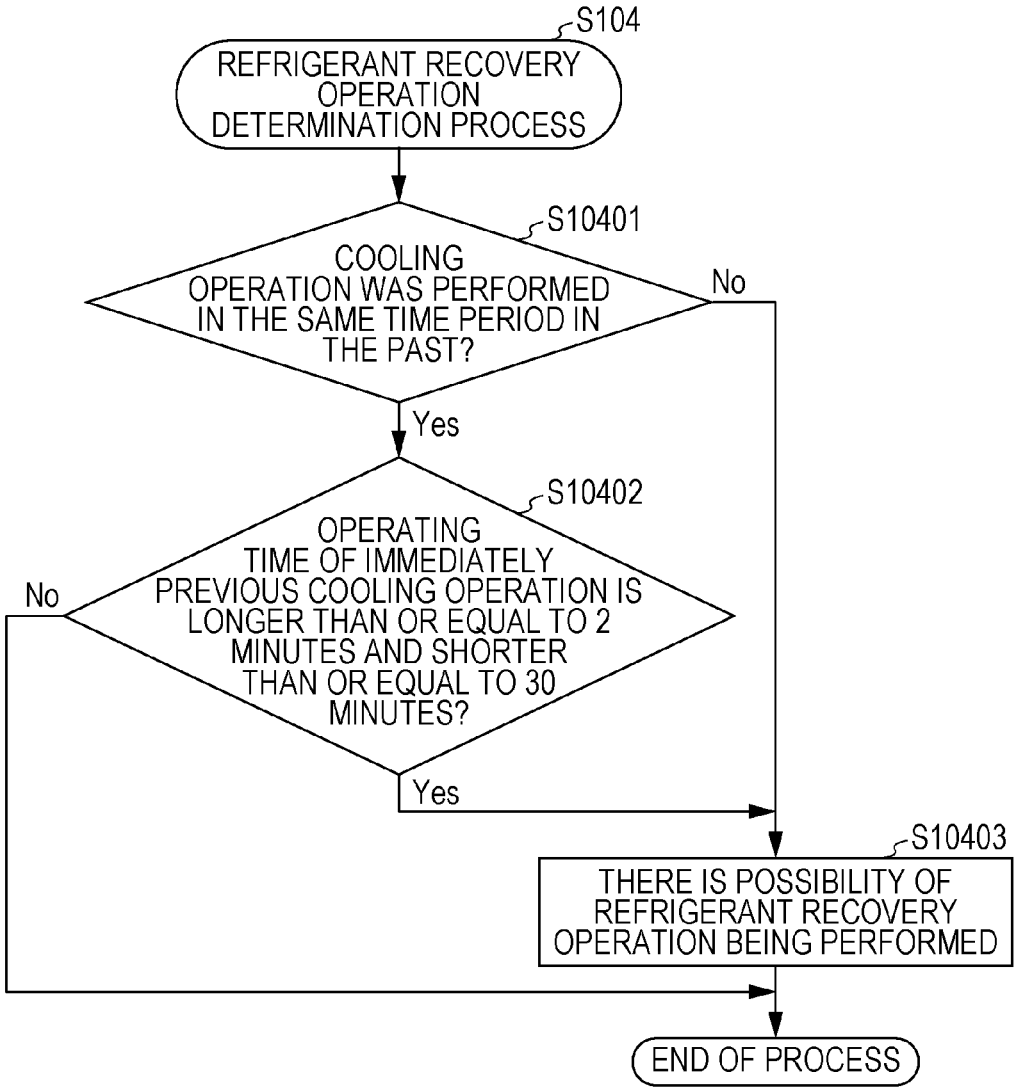
FIG. 6 is a flowchart illustrating a process of detecting a refrigerant recovery operation performed for the air conditioner according to the first embodiment of the present disclosure.

FIG. 6 is a flowchart of the refrigerant recovery operation determination process performed by the relocation determination system 6. The relocation determination system 6 determines whether the cooling operation recorded in the operation log of the air conditioner 1 corresponds to the refrigerant recovery operation performed by the engineer to relocate the air conditioner 1.

The relocation determination device 65 searches the storage device 64 to determine whether a cooling operation was performed in this time period in the past first. If a cooling operation was not performed in this time period in the past (No in S10401), the relocation determination device 65 holds the result indicating that there is a possibility of the refrigerant recovery operation being performed. Thereafter, the relocation determination device 65 completes the process. If, in the determination, a cooling operation was performed in this time period in the past (Yes in S10401), the relocation determination device 65 determines whether the operating time of the immediately preceding cooling operation is longer than or equal to 2 minutes and shorter than or equal to 30 minutes. If the operating time is not within the range (No in S10402), the relocation determination device 65 completes the process. If, in the above determination, the operating time of the immediately preceding cooling operation is longer than or equal to 2 minutes and shorter than or equal to 30 minutes (Yes in S10402), the relocation determination device 65 holds the result indicating that there is a possibility of the refrigerant recovery operation of the air conditioner 1 being performed. Thereafter, the relocation determination device 65 completes the process.

Note that in the example of the operation log illustrated in FIG. 5, the comparison is made by defining "this time period in the past" as the "same date and time last year". However, the operation log may be compared with the operation logs collected in the same month last year, the same week last year, or the same day last year, which are considered as the same time period or the same season. In addition, in step S20602, the range of 2 minutes to 30 minutes (inclusive) is used for determination. However, the operating time may be shorter than this time period, since the refrigerant can be recovered even in a short time.

In the case where the refrigerant recovery operation determination process (S104) is applied to the operation mode illustrated in FIG. 5 as an example, the operation logs R101 and R102 collected in the same time period in the past indicate that a heating operation is performed, and no cooling operation is logged. As a result, the relocation determination device 65 holds the result indicating that there is a possibility of the refrigerant recovery operation being performed. Thereafter, the relocation determination device 65 completes the process.

The test operation notification process (S107) is described in detail below with reference to FIGS. 7 and 8.

Figure 7:
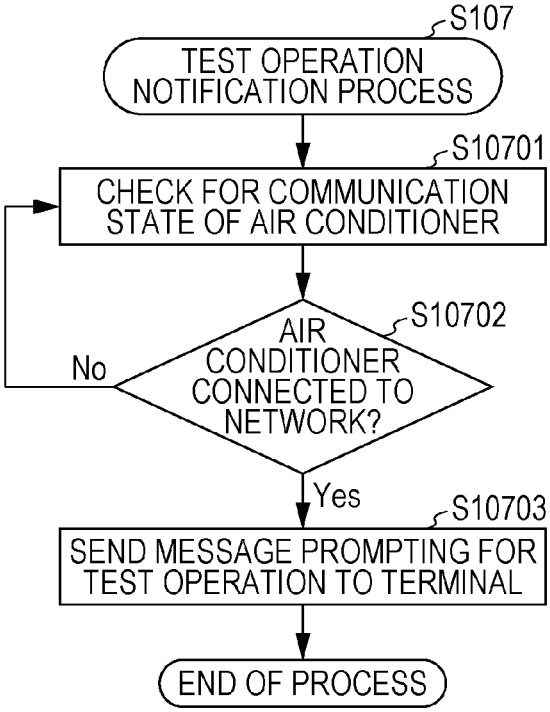
FIG. 7 is a flowchart illustrating a test operation notification process to a terminal according to an embodiment of the present disclosure.

FIG. 7 is a flowchart of a test operation notification process operation performed by the relocation determination system 6. Upon detecting that the air conditioner 1 has been relocated, the relocation determination system 6 sends a message prompting the user to perform a test operation.

The relocation determination system 6 periodically and continuously checks the network connection state of the air conditioner 1 first (S10701). When relocating the air conditioner 1, the engineer powers off the air conditioner 1 in order to uninstall the indoor unit 11 and the outdoor unit 12 during the relocation work. Consequently, the air conditioner 1 is not connected to the network. When the relocation work is completed and, thus, the global network 4 is available in the house of the user, the network connection of the air conditioner 1 is recovered. When the air conditioner 1 is connected to the network (S10702), the test operation notification device 66 sends, to the terminal 5, a message prompting for a test operation by using the communication device 63 (S10703). Thereafter, the test operation notification device 66 completes the process.

Note that the destination to which the test operation notification device 66 sends a message prompting for the test operation may be the air conditioner 1 instead of the terminal 5. Upon receiving the message, the air conditioner 1 may provide the message to the user by including a sound source and outputting alarm sound, including an LED and illuminating the LED, or including liquid crystal screen and displaying the message. Alternatively, by enabling bidirectional communication between the air conditioner 1 and the remote controller 2, the air conditioner 1 that has received the message may send a message prompting for a test operation to the remote controller 2, which displays the message thereon. In this manner, the test operation notification device 66 may send the message to the user.

Figure 8:
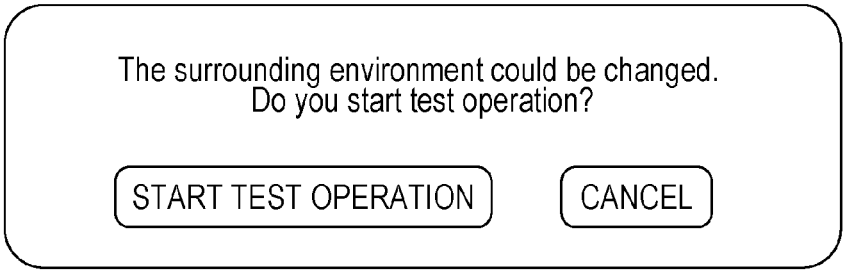
FIG. 8 illustrates an example of a test operation notification screen of a terminal according to an embodiment of the present disclosure.

FIG. 8 illustrates an example of a test operation notification screen of the terminal 5. As illustrated in FIG. 8, for example, a text message stating that the user needs to perform a test operation to ensure proper operation since the surrounding environment of the air conditioner 1 is changed due to relocation is displayed on the screen. In addition, a test operation start button and a cancel button are displayed so that upon receiving the message, the user can immediately perform a test operation or the user can perform a test operation later. If the user selects a test operation start button, the terminal 5 sends, to the air conditioner 1, an operation instruction request for starting a test operation. In this case, the air conditioner 1 performs a test operation.

The operation performed by the relocation determination system 6 has been described above.

Second Embodiment

A second embodiment is described in detail below. According to the above-described first embodiment, the relocation work is detected, in which the refrigerant recovery operation is performed with the air conditioner 1 connected to the network and, thereafter, the air conditioner 1 is powered off. Subsequently, a message prompting the user to perform a test operation is sent. According to the present embodiment, a relocation work is detected, in which the refrigerant recovery operation is performed with the air conditioner 1 disconnected from the network and, thereafter, the air conditioner 1 is powered off. Subsequently, a message prompting the user to perform a test operation is sent. Such an operation is described below.

Note that the schematic configuration of the air conditioner 1, the schematic configuration of the relocation determination system 6, an example of a test operation notification process (S107) and a test operation notification screen of a terminal 5 according to the present embodiment are the same as those of the first embodiment illustrated in FIGS. 1 to 3 and FIGS. 7 and 8, and descriptions thereof are not repeated.

The operation performed by a relocation determination system 6 according to the present embodiment is described below with reference to FIG. 9.

Figure 9:
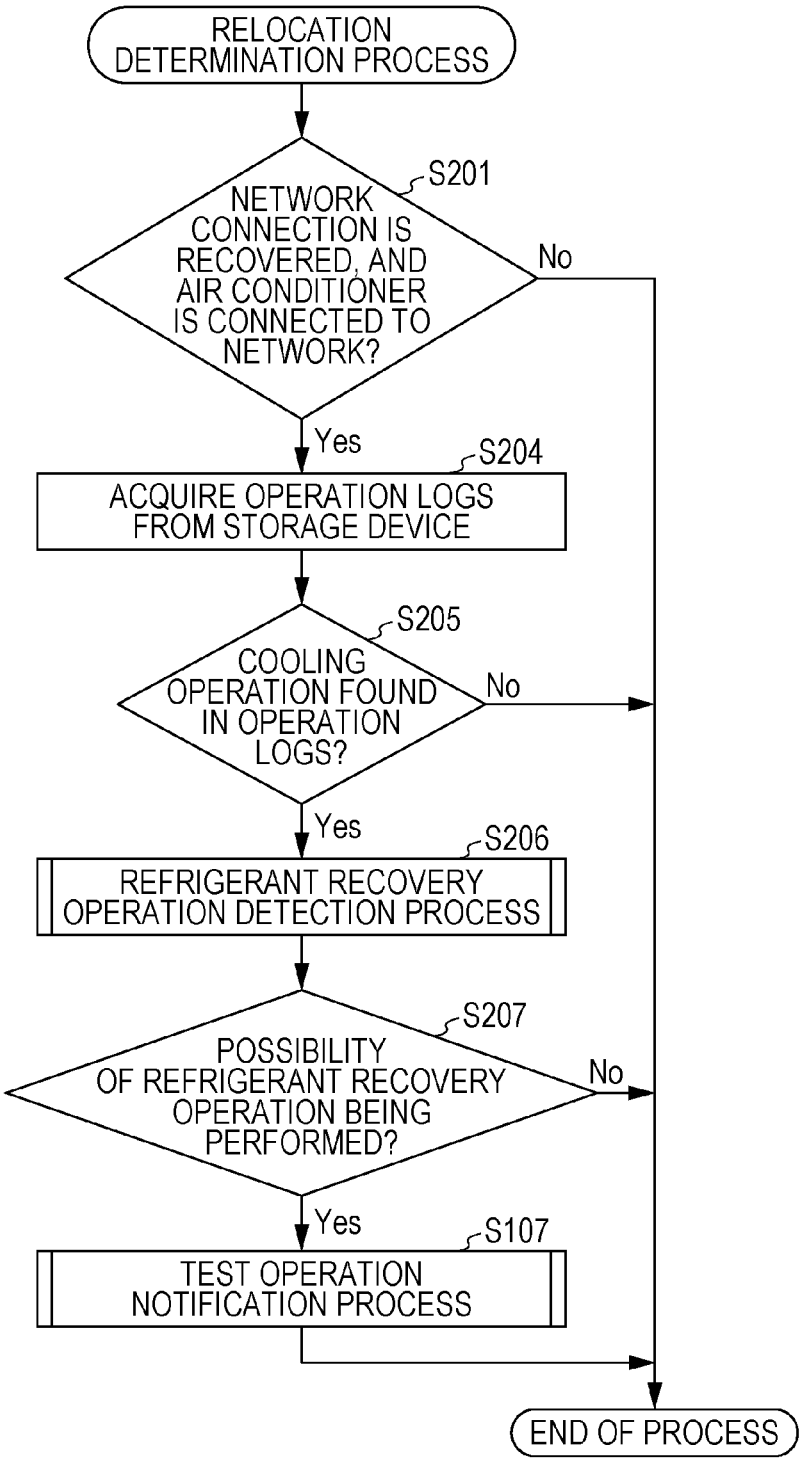
FIG. 9 is a flowchart illustrating an air conditioner relocation detection process according to a second embodiment of the present disclosure.

FIG. 9 is a flowchart of the operation process performed by the relocation determination system 6. The relocation determination system 6 periodically and continuously performs the process in order to detect whether the air conditioner 1 has been relocated. Note that in the following figures, the same reference numerals are given to the same processes as those already described, and redundant descriptions are not repeated as appropriate.

The process performed in step S107 is the same as the process described in the first embodiment, and description of the process is not repeated.

The relocation determination device 65 periodically and continuously determines whether the air conditioner 1 is connected to the network (S201) and stores the network connection state in the storage device 64. If, in the determination, the air conditioner 1 is not connected to the network (No in S201), the relocation determination device 65 completes the process. If, in the determination, the air conditioner 1 is connected to the network (Yes in 3201), the sensor value/operation log collection device 62 periodically and continuously collects the operation log of the air conditioner 1 and stores the operation log in the storage device 64. Consequently, the operation logs collected during a time period during which no network connection was made are acquired from the storage device 64 (S204). If a cooling operation log is not found in the operation logs (No in S205), the relocation determination device 65 completes the process. If a cooling operation log is found in the operation logs (Yes in S205), the relocation determination device 65 performs a refrigerant recovery operation determination process (S206) to determine whether the cooling operation corresponds to the refrigerant recovery operation. If it is determined that there is no possibility of the refrigerant recovery operation being performed (No in S207), the relocation determination device 65 completes the process. If, in the refrigerant recovery operation determination process (S206), it is determined that there is a possibility of the refrigerant recovery operation being performed (Yes in S207), the relocation determination device 65 performs a test operation notification process (S107) in which the test operation notification device 66 sends, to the air conditioner 1, a message prompting for a test operation of the air conditioner 1. Thereafter, the relocation determination device 65 completes the process.

The refrigerant recovery operation determination processing (3206) is described in detail below with reference to FIGS. 10 and 11.

FIG. 10 illustrates an example of the operation logs stored in the storage device 64. R203 represents an operation log recorded by the relocation determination device 65 when the relocation determination device 65 detected that the air conditioner 1 is not connected to the network. Operation logs R204, R205, and R206 of the air conditioner 1 are the operation logs collected by the sensor value/operation log collection device 62 when the air conditioner 1 is connected to the network again. The above-described operation logs are operation logs collected during a time period during which no network connection was made and are a plurality of operation logs held by the air conditioner 1 in the memory 117 of the indoor unit 11. Operation logs R201 and R202 are operation logs collected over the same time period in the past.

Note that in the example of FIG. 10, the operating state is collected from the air conditioner 1 every 10 minutes. However, the collection time may differ from 10 minutes. Note that the operation logs R204, 8205, and 8206 are held in the memory 117 at the points in time when the indoor unit 11 is controlled. The points in time need not be periodical and the intervals may differ from each other.

Figure 11:
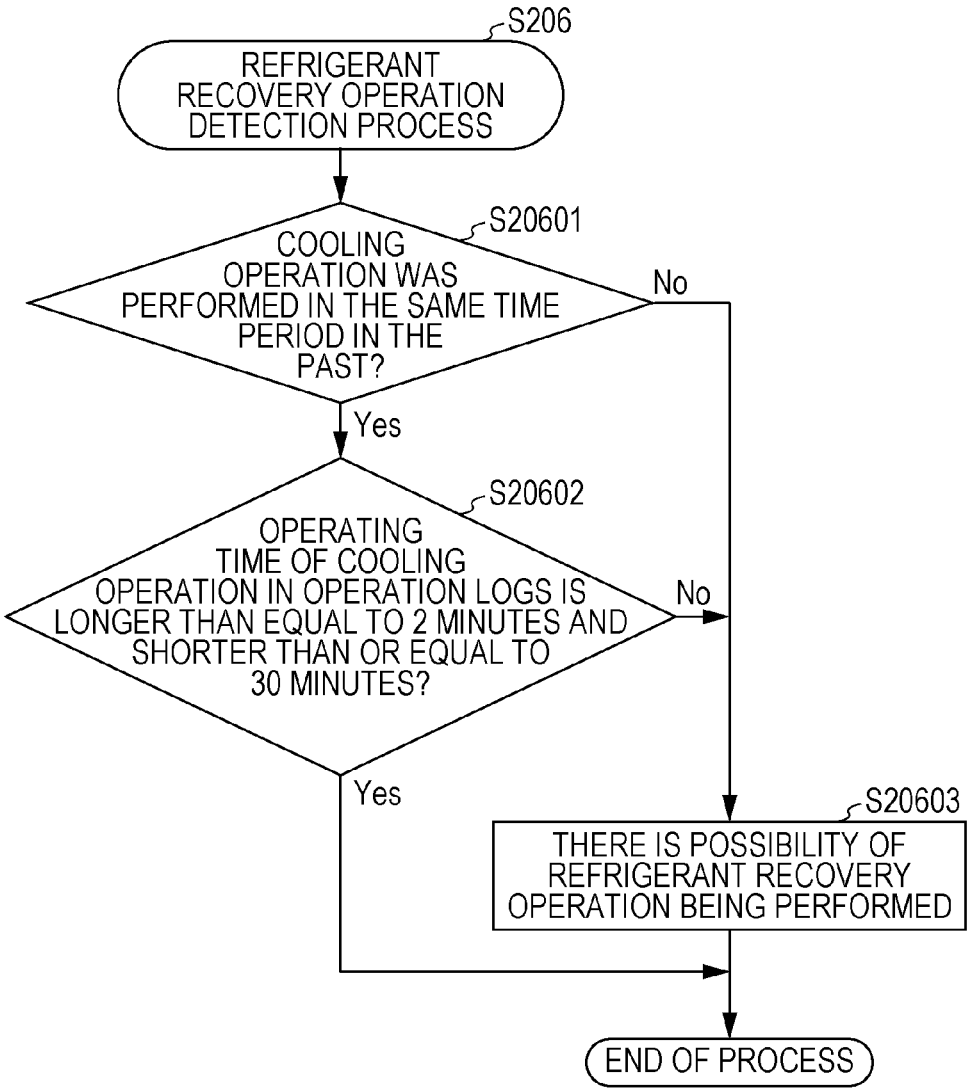
FIG. 11 is a flowchart illustrating a process of detecting a refrigerant recovery operation performed for the air conditioner according to the second embodiment of the present disclosure.

FIG. 11 is a flowchart of the refrigerant recovery operation determination process operation performed by the relocation determination system 6. The relocation determination system 6 determines whether the cooling operation in the operation log of the air conditioner 1 corresponds to the refrigerant recovery operation performed by an engineer in order to relocate the air conditioner 1.

The relocation determination device 65 searches the storage device 64 to determine whether a cooling operation was performed in this time period in the past as the period during which a cooling operation is performed with the air conditioner 1 disconnected from the network first. If a cooling operation was not performed in this time period in the past (No in S20601), the relocation determination device 65 holds the result indicating that there is a possibility of the refrigerant recovery operation being performed. Thereafter, the relocation determination device 65 completes the process. If, in the determination, a cooling operation was performed in this time period in the past (Yes in S20601), the relocation determination device 65 determines whether the operating time of the immediately preceding cooling operation is longer than or equal to 2 minutes and shorter than or equal to 30 minutes. If the operating time is not within the range (No in S20602), the relocation determination device 65 completes the process. If, in the above determination, the operating time of the immediately preceding cooling operation is longer than or equal to 2 minutes and shorter than or equal to 30 minutes (Yes in S20602), the relocation determination device 65 holds the result indicating that there is a possibility of the refrigerant recovery operation being performed. Thereafter, the relocation determination device 65 completes the process.

Note that in the example of the operation log illustrated in FIG. 5, the comparison is made by defining "this time period in the past" as the "same date and time last year". However, the operation log may be compared with the operation logs collected in the same month last year, the same week last year, or the same day last year, which are considered as the same time period or the same season. In addition, in step S20602, the range of 2 minutes to 30 minutes (inclusive) is used for determination. However, the operating time may be shorter than this time period, since the refrigerant can be recovered even in a short time.

In the case where the refrigerant recovery operation determination process (S104) is applied to the operation modes illustrated in FIG. 10 as an example, the operation log R205 indicating that a cooling operation is performed with the air conditioner 1 disconnected from the network. The operation logs R201 and R202 logged in the same time period in the past indicate that a heating operation was performed, and no cooling operation is logged. As a result, the relocation determination device 65 holds the result indicating that there is a possibility of the refrigerant recovery operation being performed. Thereafter, the relocation determination device 65 completes the process.

The operation performed by the relocation determination system 6 has been described above.

Third Embodiment

A third embodiment is described in detail below. According to the first and second embodiments described above, a relocation work in which the air conditioner 1 performs a refrigerant recovery operation and the air conditioner 1 is powered off is detected, and a message prompting the user to perform a test operation is sent. According to the present embodiment, the following operation is performed. That is, the value of a sensor mounted in the air conditioner 1 is recorded, relocation is detected from a change in the surrounding environment of the air conditioner 1, and a message prompting the user to perform a test operation. Such an operation is described below.

Note that the schematic configuration of the air conditioner 1, the schematic configuration of a relocation determination system 6, an example of a test operation notification process (S107) and a test operation notification screen of a terminal 5 according to the present embodiment are the same as those of the first embodiment illustrated in FIGS. 1 to 3 and FIGS. 7 and 8, and descriptions thereof are not repeated.

The operation performed by the relocation determination system 6 according to the present embodiment is described below with reference to FIG. 12.

Figure 12:
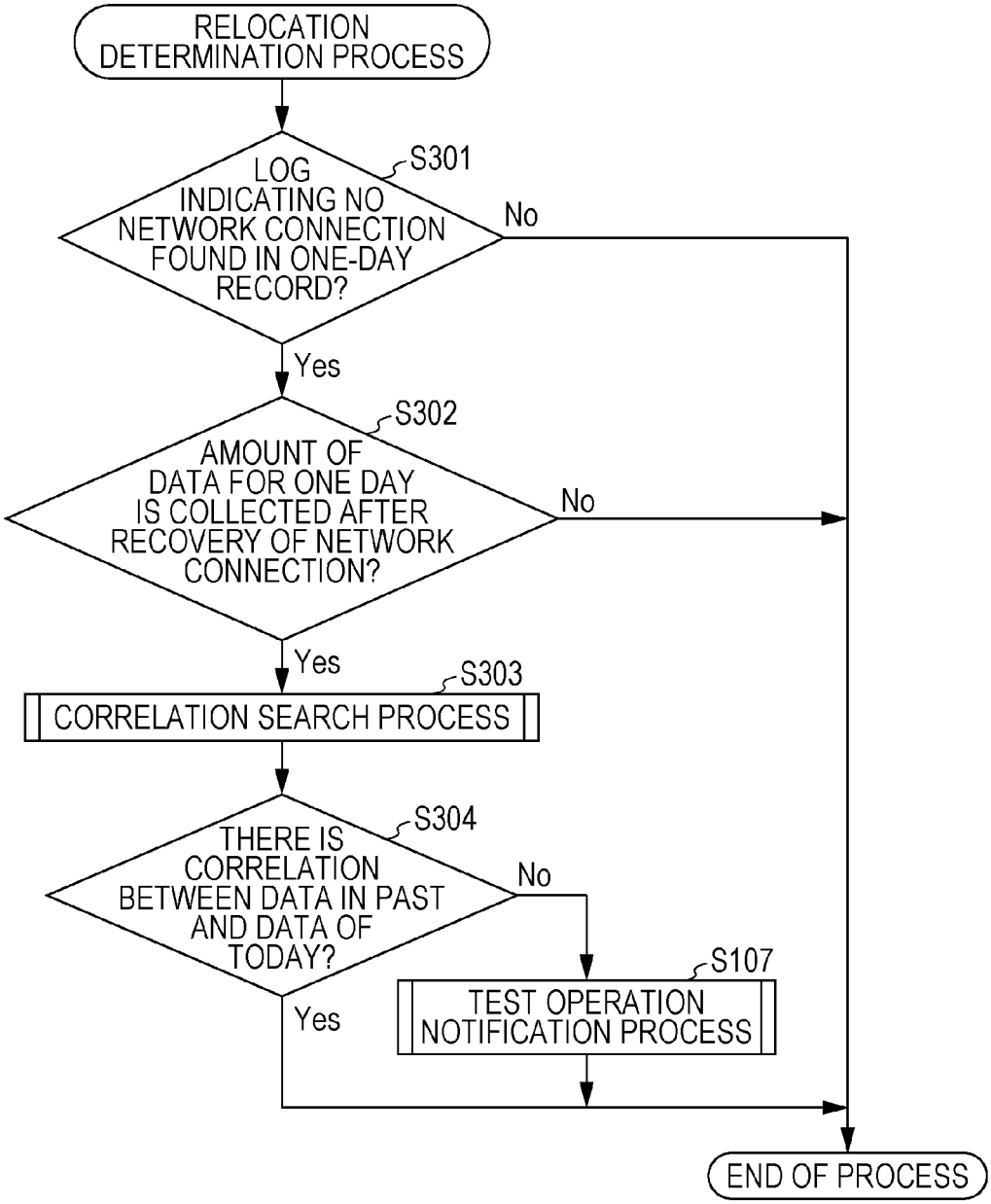
FIG. 12 is a flowchart illustrating an air conditioner relocation detection process according to a third embodiment of the present disclosure.

FIG. 12 is a flowchart of the operation process performed by the relocation determination system 6. The relocation determination system 6 periodically and continuously performs this process in order to detect whether the air conditioner 1 has been relocated. In the following figures, the same reference numerals are given to the same processes as those already described, and redundant descriptions are not repeated as appropriate.

The process performed in step 3107 is the same as the process described in the first embodiment, and description of the process is not repeated.

The relocation determination device 65 periodically and continuously determines whether the air conditioner 1 is connected to the network, determines whether a log indicating no network connection is found in the logs for one day (S301), and records the network connection state in the storage device 64. If, in the determination, a log indicating that the air conditioner 1 is not connected to the network is not found in the logs recorded for one day (No in 3301), the relocation determination device 65 completes the process. If, in the above determination, a log indicating that the air conditioner 1 is not connected to the network is found in the logs recorded for one day (Yes in S301), the relocation determination device 65 determines whether the sensor value information of the air conditioner 1 periodically and continuously collected by the sensor value/operation log collection device 62 after the network connection is recovered and recorded in the storage device 64 is accumulated for one day. If the sensor value information for one day is not accumulated (No in S302), the relocation determination device 65 completes the process. If, in the determination process, the information recorded after the network connection is recovered is accumulated for one day (Yes in S302), the relocation determination device 65 performs a correlation search process (S303) of determining whether there is a correlation between the data of today and the data in the past (S304). If, in the above determination, there is a correlation (Yes in S304), the relocation determination device 65 completes the process. If, in the above determination, there is no correlation (No in S304), the relocation determination device 65 determines that the air conditioner 1 has been relocated and performs the test operation notification process (S107) in which the test operation notification device 66 sends, to the air conditioner 1, a message prompting for a test operation. Thereafter, the relocation determination device 65 completes the process.

The correlation search process (S303) is described in detail below with reference to FIGS. 13, 14, 15, and 16.

FIG. 13 illustrates an example of the sensor values that are collected for one day after the network connection is recovered and that are stored in the storage device 64. The room temperature in FIG. 13 is a value measured by the temperature sensor 114 of the indoor unit 11. The outdoor temperature in FIG. 13 is a value measured by the temperature sensor 123 of the outdoor unit 12.

FIG. 14 illustrates an example of sensor values that are collected in the same time period in the past as the time period during which the sensor values of FIG. 13 are collected and that are stored in the storage device 64.

Figure 15:
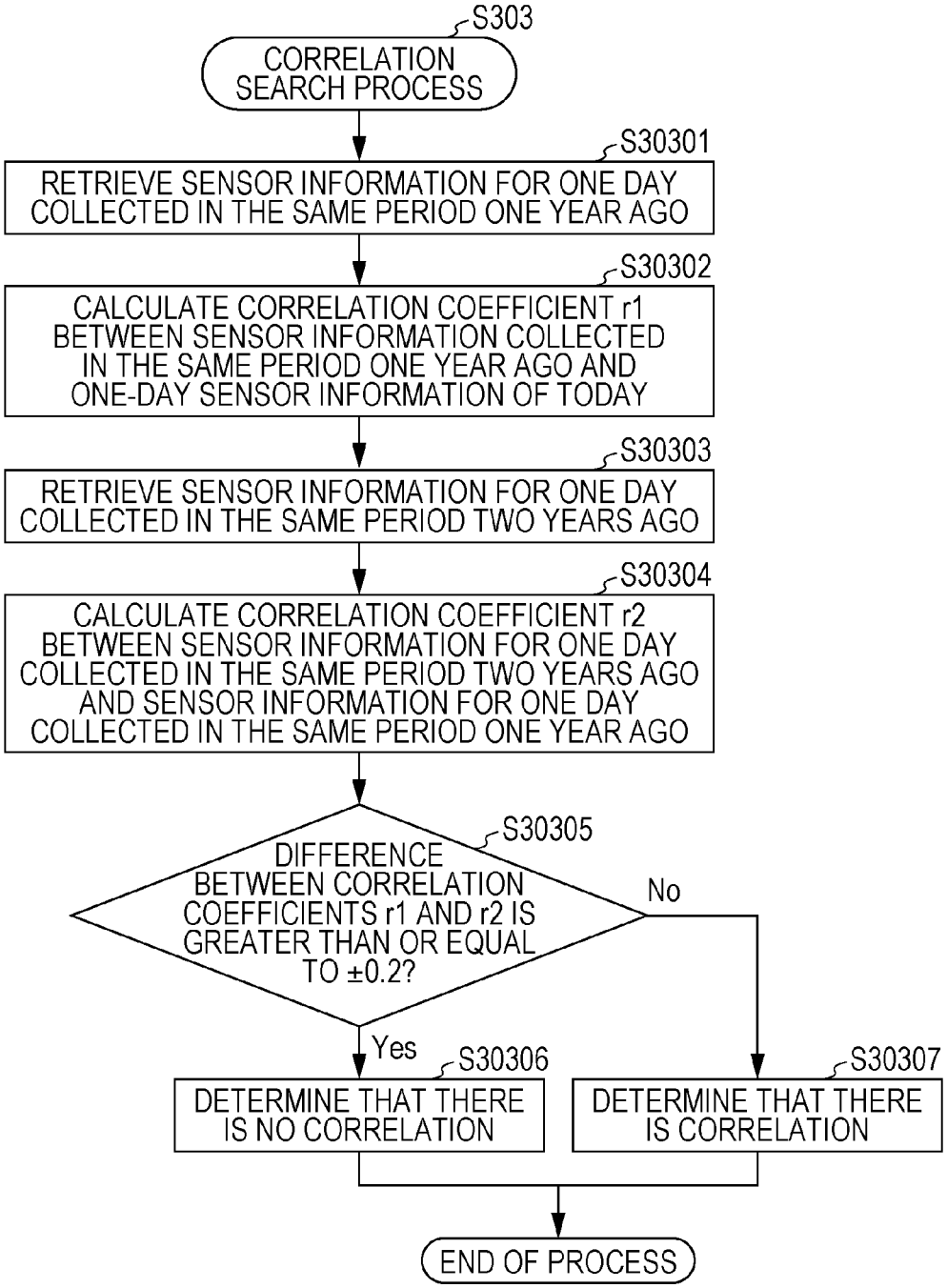
FIG. 15 is a flowchart illustrating an example of a correlation search process according to the third embodiment of the present disclosure.

FIG. 15 is a flowchart of the correlation search process operation performed by the relocation determination system 6. After the network connection of the air conditioner 1 is recovered, the relocation determination system 6 determines whether there is a correlation between the collected sensor values and the sensor values collected in the same time period in the past.

The relocation determination device 65 retrieves, from the storage device 64, the sensor values for one day collected in the same time period one year ago as the time period in which sensor values collected after the network connection is recovered (hereinafter referred to as "sensor values of today") first (S30301). The relocation determination device 65 calculates a correlation coefficient r1 between the sensor values collected in the same time period one year ago and the sensor values of today and holds the calculation result (S30302). The correlation coefficient r1 can be calculated as follows:

$$r = \frac{\sum_{i=1}^{n} (x_i - \bar{x})(y_i - \bar{y})}{\sqrt{\sum_{i=1}^{n} (x_i - \bar{x})^2 \sum_{i=1}^{n} (y_i - \bar{y})^2}} \quad (1)$$

In equation (1), $x_i$ represents the first to n-th sensor values of today, and $\bar{x}$ (x-bar) indicates the average value of sensor values of today. In FIG. 13, the first sensor value is the sensor value in 1301 and the n-th sensor value is the sensor value in R302. $y_i$ represents the first to n-th sensor values collected in the same time period one year ago, and $\bar{y}$ (y-bar) represents the average value of sensor values collected in the same time period one year ago. In FIG. 14, the first sensor value is the sensor value in R403, and the n-th sensor value is the sensor value in 8404. The calculation results of the correlation coefficient r1 between the sensor values collected in the same time period one year ago and the sensor values of today for the room temperature and the outdoor temperature in FIGS. 13 and 14 are indicated by R501 in FIG. 16.

Subsequently, the relocation determination device 65 retrieves, from the storage device 64, the sensor values for one day collected in the same time period two years ago as the time period during which the sensor values of today are collected (S30303). The relocation determination device 65 also calculates a correlation coefficient r2 between the sensor values collected in the same period one year ago and the sensor values collected in the same period two years ago and holds the result of calculation (S30304). The correlation coefficient r2 can be calculated by the above-described equation (1). In FIG. 14, the first sensor value is the sensor value in R401, and the n-th sensor value is the sensor value in 8402. The calculation results of the correlation coefficient r2 between the sensor values collected in the same time period one year ago and the sensor values collected in the same period two years ago for the room temperature and the outdoor temperature in FIG. 14 are indicated by R502 in FIG. 16. If the difference between the correlation coefficients calculated in steps S30302 and S30304 is not greater than or equal to ±0.2 (No in S30305), the relocation determination device 65 determines that there is a correlation and holds the result (S30307). Thereafter, the relocation determination device 65 completes the process. If, in the above determination, the difference in the correlation coefficient is greater than or equal to ±0.2 (Yes in S30305), the relocation determination device 65 determines that there is no correlation and holds the result (S30306). Thereafter, the relocation determination device 65 completes the process.

Figures 16, 17:
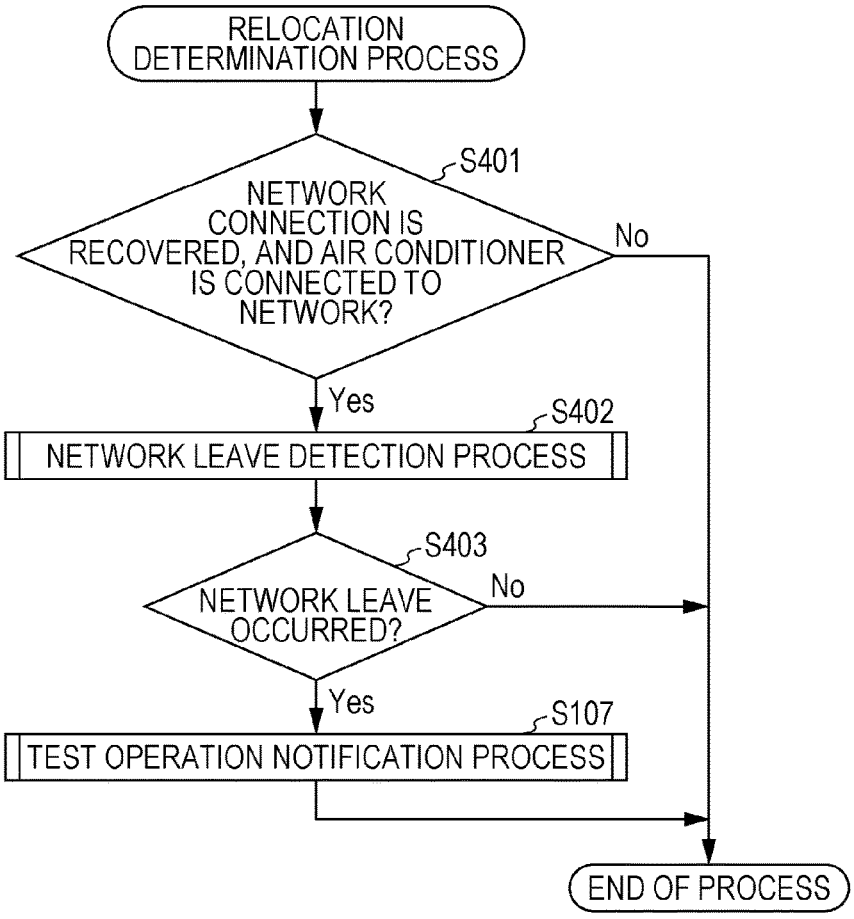
FIG. 16 illustrates a correlation coefficient of the sensor information for one day illustrated in FIG. 13 as an example and a correlation coefficient of the sensor information in the past years at the same period illustrated in FIG. 14 as an example according to the third embodiment of the present disclosure.
FIG. 17 is a flowchart illustrating an air conditioner relocation detection process according to a fourth embodiment of the present disclosure.

In the case of the correlation coefficients illustrated in FIG. 16 as an example, since the difference between the correlation coefficients for the room temperature indicated by R501 and R502 is greater than or equal to 0.2, it is determined that there is no correlation at step S503 of the correlation search process.

Note that in the examples illustrated in FIGS. 13 and 14, the sensor value/operation log collection device 62 periodically performs collection at one-hour intervals. However, the collection interval may differ from the interval. Note that in the examples of the sensor values illustrated in FIGS. 13 and 14, comparison is made by defining the "same period in the past" as the "same day last year". However, the sensor value may be compared with, for example, the sensor values collected in the same month last year, the same week last year, or in the same hour last year, which can be considered as the same period or season. Note that in the examples illustrated in FIGS. 13 and 14, the room temperature and the outdoor temperature are used as the sensor values. However, other sensors, such as temperature sensors or illuminance sensors mounted at other locations, may be employed.

The operation performed by the relocation determination system 6 has been described above.

Fourth Embodiment

A fourth embodiment is described in detail below. According to the first and second embodiments described above, a relocation work in which the air conditioner 1 performs the refrigerant recovery operation and, thereafter, is powered off, is detected, and a message prompting the user to perform a test operation is sent. According to the third embodiment described above, the values from a sensor mounted in the air conditioner 1 is stored, and relocation is detected from a change in the surrounding environment of the air conditioner 1. Thereafter, a message prompting a user to perform a test operation is sent to the user. According to the present embodiment, when the network connection of the air conditioner 1 is recovered, relocation is detected by determining whether the air conditioner 1 has exit the previously connected network connection environment and has joined another connection environment. Thereafter, a message prompting the user to perform a test operation is sent. Such an operation is described below.

Note that the schematic configuration of the air conditioner 1, the schematic configuration of the relocation determination system 6, an example of a test operation notification process (S107) and a test operation notification screen of a terminal 5 according to the present embodiment are the same as those of the first embodiment illustrated in FIGS. 1 to 3 and FIGS. 7 and 8, and descriptions thereof are not repeated.

The operation performed by a relocation determination system 6 according to the present embodiment is described below with reference to FIG. 17.

FIG. 17 is a flowchart of the operation process performed by the relocation determination system 6. The relocation determination system 6 periodically and continuously performs the process in order to detect whether the air conditioner 1 has been relocated. In the following figures, the same reference numerals are given to the same processes as those already described, and redundant descriptions are not repeated as appropriate.

The processing in step S107 is the same as the processing described in the first embodiment, and description of the processing is not repeated.

The relocation determination device 65 periodically and continuously determines whether the air conditioner 1 is connected to the network and determines whether the air conditioner 1 is connected to the network again after a non-connected mode. If the air conditioner 1 is not connected to the network (No in S401), the relocation determination device 65 completes the process. If, in the above determination process, the air conditioner 1 is connected to the network (Yes in S401), the relocation determination device 65 performs a network leave detection process (S402) to determine whether the air conditioner 1 has exit the network connection environment to which the air conditioner 1 was previously connected and has joined another connection environment. If, in the above determination, the air conditioner 1 has not exit the network (No in S403), the relocation determination device 65 completes the process. If, in the above determination process, the air conditioner 1 has exit the network (Yes in S403), the relocation determination device 65 performs the test operation notification process (S107) in which the test operation notification device 66 sends a message prompting for a test operation to the air conditioner 1. Thereafter, the relocation determination device 65 completes the process.

The network leave detection process (S402) is described in detail below with reference to FIGS. 18 and 19.

The relocation determination device 65 examines the connection information of the adapter 3 of the air conditioner 1 in the storage device 64. Examples of the connection information include an IP address and identification information. The relocation determination device 65 determines whether the connection information differs from the previous connection information (S40202). If the connection information remains unchanged (No in S40202), the relocation determination device 65 determines that the air conditioner 1 has not exit the network and holds the result (S40204). Thereafter, the relocation determination device 65 completes the process. If, in the above determination process, the connection information differs from the previous connection information (Yes in S40202), the relocation determination device 65 determines that the air conditioner 1 has exit the network and holds the result (S40203). Thereafter, the relocation determination device 65 completes the process.

Figures 18, 19:
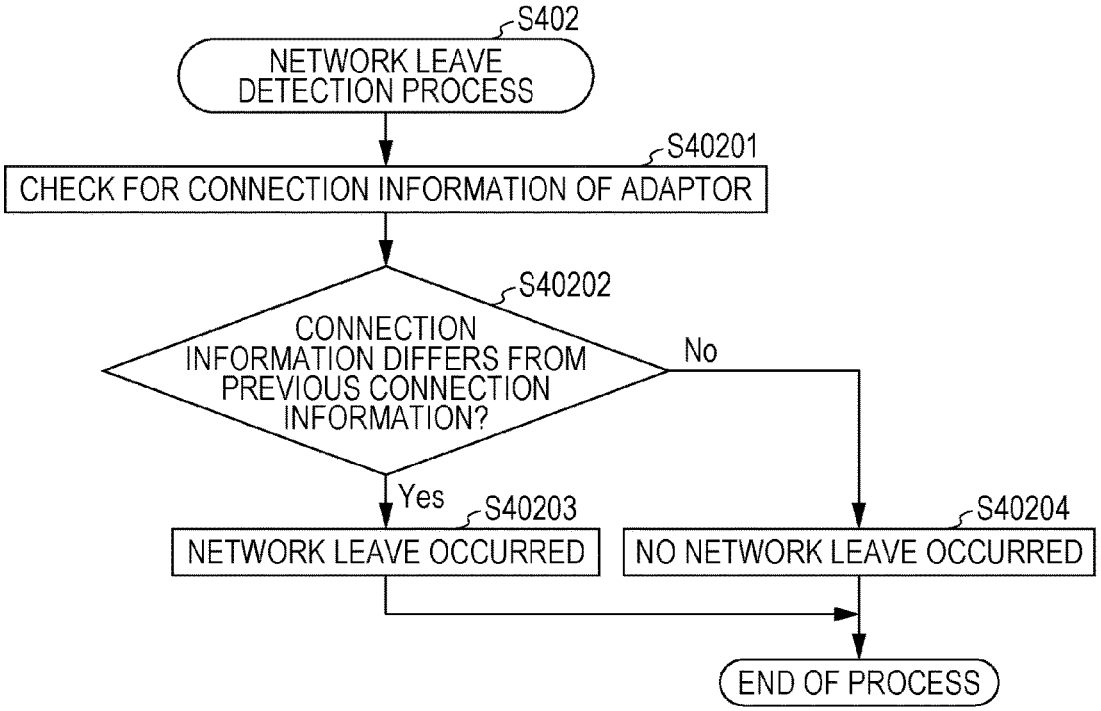
FIG. 18 is a flowchart illustrating a process of detecting the exit of the air conditioner from a network according to the fourth embodiment of the present disclosure.
FIG. 19 illustrates an example of connection information of an adapter of an air conditioner stored in a storage device.

FIG. 19 illustrates an example of the connection information of the adapter 3 of the air conditioner 1 stored in the storage device 64. The air conditioner identification number in FIG. 19 is the information for identifying an air conditioner, and the identification number in a row R601 illustrated in FIG. 19 indicates the air conditioner 1 according to the present embodiment. The values of the modification date and time column in FIG. 19 remain unchanged unless the connection information changes. If the connection information changes, the modification date and time value of the corresponding air conditioner is overwritten by the date and time when the change is detected, and the IP address value is also overwritten.

Note that in the example illustrated in FIG. 18, the connection information of the adapter 3 is checked. However, when the function of the adapter 3 is included in the air conditioner 1, the connection information in the air conditioner 1 may be checked. In the example illustrated in FIG. 19, the most recent connection information of the air conditioner 1 is retained. However, the log of a change in the connection information of the air conditioner 1 may be retained across a plurality of rows.

Referring to the connection information illustrated in FIG. 19, when the network leave detection process in step S402 is performed at 2015 Mar. 4 11:00, it is determined that the connection information differs from the previous connection information in step S40202 since the connection information of the air conditioner 1 has been updated. Thus, it is determined in step S40203 that network leave has occurred. The relocation determination device 65 holds the result and completes the process.

The operation performed by the relocation determination system 6 has been described above.

While the embodiments of the present disclosure have been described in detail with reference to the attached drawings, particular configurations are not limited to those of the embodiments, and designs that do not depart from the scope and sprit of the present disclosure are intended to be included within the present disclosure.

The present disclosure is useful as a method for detecting relocation of an air conditioner that has been relocated and as an information notification system that sends a message prompting the user to perform a test operation.

What is claimed is:

1. An information notification method for use in an information notification system connected via a network to an air conditioner including a refrigerant circuit and an information communication apparatus, comprising:

detecting a connection state indicating whether the air conditioner is connected to the network;

receiving, from the air conditioner, operation log information indicating an operation log of the air conditioner;

determining whether the air conditioner performed a refrigerant recovery operation on the refrigerant circuit on a basis of the operation log information;

determining whether the air conditioner has been relocated on a basis of the detected connection state and the determination as to whether the air conditioner performed the refrigerant recovery operation; and sending, to the information communication apparatus, first information used to prompt for a test operation of the air conditioner if it is determined that the air conditioner has been relocated.

2. The information notification method according to claim 1, wherein when it is determined that the air conditioner has performed the refrigerant recovery operation and if it is detected that the air conditioner is not connected to the network, it is determined that the air conditioner has been relocated.

3. The information notification method according to claim 1, wherein the operation log information includes an operating start time, an operation mode, a setting temperature, and an operating time of the air conditioner.

4. The information notification method according to claim 1, wherein if the operation log information indicates that the air conditioner was not operated in the same period of past years as a first date and time and in the same operation mode as at the first date and time, it is determined that the refrigerant recovery operation is performed at the first date and time.

5. The information notification method according to claim 1, wherein if the operation log information indicates that a continuous operating time of the air conditioner at a first date and time is within a predetermined time, it is determined that the refrigerant recovery operation is performed at the first date and time.

6. The information notification method according to claim 1, wherein if it is detected that the air conditioner is not connected to the network at a first date and time and the air conditioner is connected to the network again at a second date and time, it is determined whether the refrigerant recovery operation was performed in a period of time of past years from the first date and time to the second date and time on a basis of the operation log information, and wherein if it is determined that the refrigerant recovery operation was performed, it is determined that the air conditioner has been relocated.

7. The information notification method according to claim 1, wherein the operation log information includes an operating start time, an operation mode, a setting temperature, an operating time, and a network connection/disconnection state of the air conditioner.

8. The information notification method according to claim 1, wherein the air conditioner includes indoor equipment and outdoor equipment, and wherein the operation log information includes first temperature information indicating a room temperature in a room in which the indoor equipment is installed and second temperature information indicating a temperature of outdoor air in which the outdoor equipment is installed.

9. The information notification method according to claim 7, wherein if it is detected that the air conditioner is not connected to the network at a first date and time and the air conditioner is connected to the network again at a second date and time, first information and second information are calculated on a basis of the operation log information, wherein the first information indicates a temperature change tendency of an installation environment of the air conditioner during a first time period that starts from the second date and time and that is smaller than or equal to a predetermined time period, and the second information indicates a temperature change tendency of the installation environment of the air conditioner during a second time period that is the same time period of past years as the first time period, wherein the first information is compared with the second information, and wherein if there is no predetermined correlation between the first information and the second information, it is determined that the air conditioner has been relocated.

10. The information notification method according to claim 1, wherein connection information indicating a network connection state of the air conditioner is acquired, wherein if it is detected that the air conditioner is not connected to the network at a first date and time and the air conditioner is connected to the network again at a second date and time, first connection information representing the connection information before the first date and time is compared with second connection information representing the connection information after the second date and time, and wherein if the first connection information is not the same as the second connection information, it is determined that the air conditioner has been relocated.

11. The information notification method according to claim 1, wherein the information communication apparatus includes a touch-sensitive display, wherein the first information includes a program that displays a graphical user interface including an icon on the touch-sensitive display; and wherein control information that causes the air conditioner to perform a test operation is sent from the information communication apparatus via a network in response to an operation performed on the icon via the touch-sensitive display.

12. A relocation determination device for determining whether an air conditioner is relocated, the device being connected via a network to an air conditioner including a refrigerant circuit and an information communication apparatus, the device comprising:

a communicator that performs communication with the air conditioner and the information communication apparatus;

a memory that stores operation log information received from the air conditioner, the operation log information indicating an operation log of the air conditioner; and a processor that detects a connection state indicating whether the air conditioner is connected to the network, determines whether the air conditioner has performed a refrigerant recovery operation on the refrigerant circuit on a basis of the operation log information; and determines whether the air conditioner has been relocated on a basis of the detected connection state and the determination as to whether the air conditioner has performed the refrigerant recovery operation, wherein if it is determined that the air conditioner has been relocated, the communicator sends first information used to prompt for a test operation of an air conditioner to the information communication apparatus.

* * * * *